United States Patent [19]
Bacon
[11] 4,318,230
[45] Mar. 9, 1982

[54] DEMOUNTABLE DEHYDRATOR TRAY

[76] Inventor: Leon C. Bacon, 120 S. Vista, Fowler, Calif. 93625

[21] Appl. No.: 109,966

[22] Filed: Jan. 7, 1980

Related U.S. Application Data

[63] Continuation-in-part of Ser. No. 924,140, Jul. 13, 1978, abandoned.

[51] Int. Cl.[3] ..... F26B 25/18
[52] U.S. Cl. ..... 34/238; 108/56.3; 108/91; 211/153
[58] Field of Search ..... 34/192, 197, 198, 200, 34/225, 233, 237, 238; 52/825; 206/443; 108/51.1, 56.3, 53.1, 55.3, 91; 211/153

[56] References Cited

U.S. PATENT DOCUMENTS

| | | | |
|---|---|---|---|
| 230,507 | 7/1880 | Tiffany | 34/238 |
| 261,307 | 7/1882 | Cheesman | 34/238 |
| 281,273 | 7/1883 | Knox | 34/237 |
| 635,423 | 10/1899 | Chase | 34/238 |
| 825,631 | 7/1906 | Agnew | 211/153 |
| 896,185 | 8/1908 | Winchell | 34/238 |
| 1,289,204 | 12/1918 | Lane | 34/238 |
| 1,355,486 | 10/1920 | Longenecker | 34/238 X |
| 1,760,056 | 5/1930 | Hartmann | 34/238 |
| 1,777,402 | 9/1948 | La Macchia | 34/238 |
| 2,503,022 | 4/1950 | Behoist et al. | 108/56.1 X |
| 3,233,564 | 2/1966 | Sullivan | 108/53.1 |

FOREIGN PATENT DOCUMENTS

| | | | |
|---|---|---|---|
| 683252 | 3/1964 | Canada | 108/56 R |
| 996340 | 12/1951 | France | 52/825 |
| 1414638 | 11/1975 | United Kingdom | 108/55.3 |

*Primary Examiner*—Albert J. Makay
*Assistant Examiner*—Harold Joyce
*Attorney, Agent, or Firm*—Huebner & Worrel

[57] ABSTRACT

A frame for forming a tray having a plurality of slats, the frame having a pair of spaced substantially parallel assemblies, each having a pair of components engageable longitudinally of each other to form a plurality of slat receiving openings facing laterally of the assembly on a first side and obstructed on a second side of the assembly; a pair of rigid members disposed in spaced substantially parallel relation extending between and engaging corresponding opposite end portions of the assemblies in substantially right angular relation to form a frame of a substantially rectangular configuration with the first sides of the assemblies facing each other and with corresponding slat receiving openings of the assemblies aligned along substantially parallel paths between the rigid members of the pair; and fasteners securing together the components of each pair and the rigid members and the opposite end portions of the assemblies in the substantially rectangular configuration and releasable for the removal of one component of a pair for the insertion of slats individually into corresponding slat receiving openings in forming and repairing the tray.

3 Claims, 12 Drawing Figures

DEMOUNTABLE DEHYDRATOR TRAY

CROSS REFERENCE TO A RELATED APPLICATION

This application is a continuation-in-part of U.S. patent application Ser. No. 924,140, filed July 13, 1978, and now abandoned.

BACKGROUND OF THE INVENTION

1. Field of the Invention

The present invention relates to a demountable dehydrator tray and more particularly to such a tray having operative components forming a frame for the tray which facilitate the repair or replacement of worn and broken slats as well as deteriorating portions of the components themselves in such a manner as to preserve the structural integrity of the tray.

2. Description of the Prior Art

Dehydrators are employed in drying vegetative matter for a variety of purposes. Particularly where fruit is the material to be dried, most processes employ wooden trays having a plurality of slats spaced from each other to define air passages therebetween, but sufficiently close together to form a suitable supporting surface for the fruit. Such trays conventionally consist of a rigid rectangular wooden frame to which are nailed the wooden slats arranged as noted. Thousands of these trays are used in dehydrators over relatively short periods of time. During such use they are stacked in multiple layers while weighted down with fruit, subjected to the drying heat and otherwise subject to abusive treatment. As a result, the slats of the trays and the frames themselves frequently become worn and broken requiring replacement in order to permit continued use of the trays.

Rehabilitation of such worn and broken trays requires that they be disassembled by removal of the nails or staples holding them together and then reassembled using new slats. Removal of the nails and staples contributes to fragmentation and deterioration of the wooden frame. Furthermore, it is often difficult, if not impossible, to retain the precisely rectangular configuration and structural integrity desired. In any event, the operation is so onerous and time consuming and the results frequently so unsatisfactory that such dilapidated trays are frequently simply destroyed when no longer usable.

Therefore, it has long been known that it would be desirable to have a dehydrator tray which possesses a durability and dependability of operation, permits the expeditious replacement of worn and broken slats and structural components of the frame, and insures that its original configuration is precisely preserved in the reassembled tray with little or no attention to this detail of assembly.

SUMMARY OF THE INVENTION

Therefore, it is an object of the present invention to provide an improved dehydrator tray.

Another object is to provide such a tray which permits the rapid replacement of worn and broken slats so as to make the rehabilitation of such trays practical.

Another object is to provide such a tray in which both the slats and the structural components of the frame can rapidly be replaced by disassembling only a minimal portion thereof.

Another object is to provide such a tray which does not use nails, staples or the like thereby minimizing the progressive fragmentation and deterioration characteristic of conventional trays.

Another object is to provide such a tray which preserves its original rectangular configuration when reassembled without requiring the careful attention of the person reassembling the tray.

Another object is to provide such a tray which is particularly well suited to use as a kit for constructing trays wherein the user supplies his own slats for use in assembling a tray.

Another object is to provide such a tray which is of quite light weight and yet durable construction.

Another object is to provide such a tray which possesses a structure permitting a plurality of such trays to be interlocked in stacked relation and which has portions engageable to guide the trays to the interlocked arrangement.

Another object is to provide such a tray in which the structural components of each frame member are interchangeable and so designed as virtually to prevent their being improperly assembled in a complete frame.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figures 1, 12:
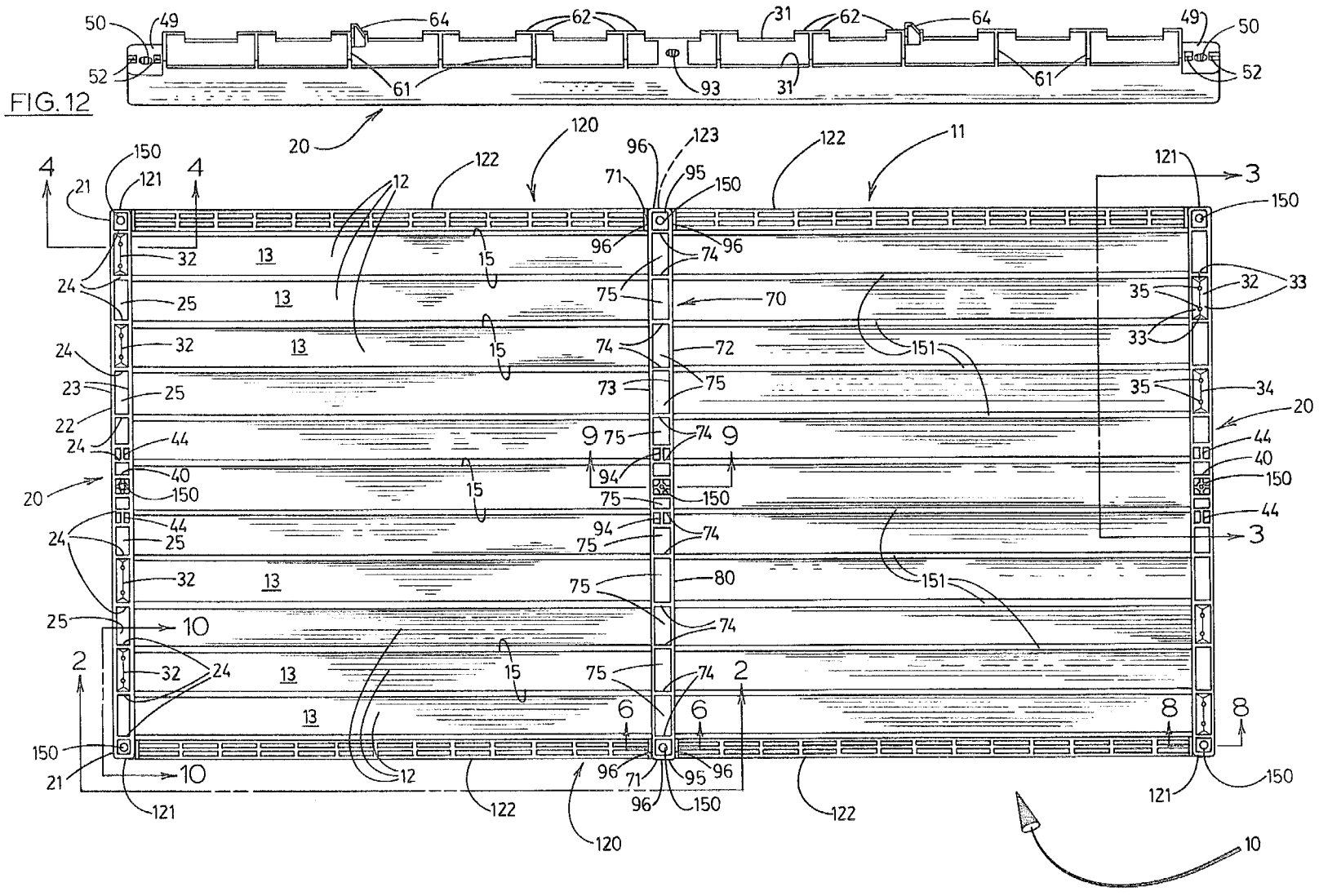
FIG. 1 is a top plan view of the demountable dehydrator tray of the present invention.
FIG. 12 is a side view of one of the components of a first cleat assembly which has been rotated to show the interlock projections thereof.

Referring more particularly to the drawings, the demountable dehydrator tray of the present invention is generally indicated at 10 in FIG. 1. The tray has a frame 11 in which, as shown in FIG. 1, a plurality of slats 12 are mounted. Each of the slats has opposite surfaces 13, opposite ends 14 and side or lateral edges 15. As shown in FIG. 1, the slats are of the conventional wood type having substantially uniform dimensions and being somewhat flexible permitting them to be bent from the plane defined thereby.

The tray frame 11 has a pair of cross members, end or first cleat assemblies 20. Each first cleat assembly of the pair has opposite end portions 21. Each of the cleat assemblies is composed of a pair of portions or components 22 which are longitudinally engageable to form their respective first cleat assembly 20, as perhaps best shown in FIG. 10. The components can be constructed of wood, plastic, or any other suitably rigid material which is preferably both durable and light in weight. It has been found that any one of a wide variety of synthetic plastic materials are well suited to this purpose where made of suitable thicknesses of material and where reinforced as necessary. It will be understood that in the preferred embodiment the components 22 are constructed of such plastic material to provide a light weight, strong and durable frame 11.

Each of the components 22 of each first cleat assembly is of substantially identical and interchangeable construction. Each component has a pair of substantially parallel side walls 23 interconnected at equally spaced intervals by a plurality of transversely extending reinforcing walls 24. Adjacent reinforcing walls bound a passage or receptacle 25 therebetween so that the component is provided with a plurality of the receptacles 25 having substantially identical dimensions.

Each component 22 of each first cleat assembly has an exterior side 30 and an opposite interior side 31. The terminology "exterior" and "interior" have reference to the relative positions to the sides of the component in its normal assembled condition forming a first cleat assembly. A plurality of projections 32, sometimes referred to herein as "exterior projections", are mounted on the exterior side 30 of each component preferably in the pattern shown in FIG. 1. The projections are mounted over alternate receptacles 25 so that, for example, as shown on the left in FIG. 1 beginning at the opposite end portion 21 in proximity to section line 4—4, a projection is mounted over the receptacle 25 nearest the opposite end portion thereof, the next successive receptacle 25 is not covered by a projection and a projection is mounted on the exterior side covering the next successive projection. Conversely, the receptacle 25 nearest the opposite end portion 21 near section line 10—10 in FIG. 1 is not covered by a projection, a projection is mounted on the exterior side covering the next successive receptacle, the next successive receptacle is not covered by a projection and the exterior side mounts a projection covering the next successive receptacle. Thus, an asymmetric pattern is formed which permits the components, though indentically constructed, to be used interchangeably as will subsequently be described in greater detail.

Each projection has a pyramid like configuration having four convergent sides 33 extending to a linear apex 34. The apexes of the projections are aligned longitudinally of their respective component and transversely of the tray and have a pair of drain holes 35 extending therethrough.

Mounted on the side walls 23 of the component 22 within the centermost receptacle 25 is a central housing 40. The central housing has side walls 41 mounted on and extending between the side walls 23 of the component in spaced relation. The side walls 41 are interconnected by a reinforced floor 42 which is flush with the interior side 31 of the component and has a bolt hole 43 extended therethrough. A pair of T-shaped braces 44 are individually mounted on the side walls 23 of the component in bracing relation to the reinforcing walls 24 on opposite sides of the central housing.

Figure 10:
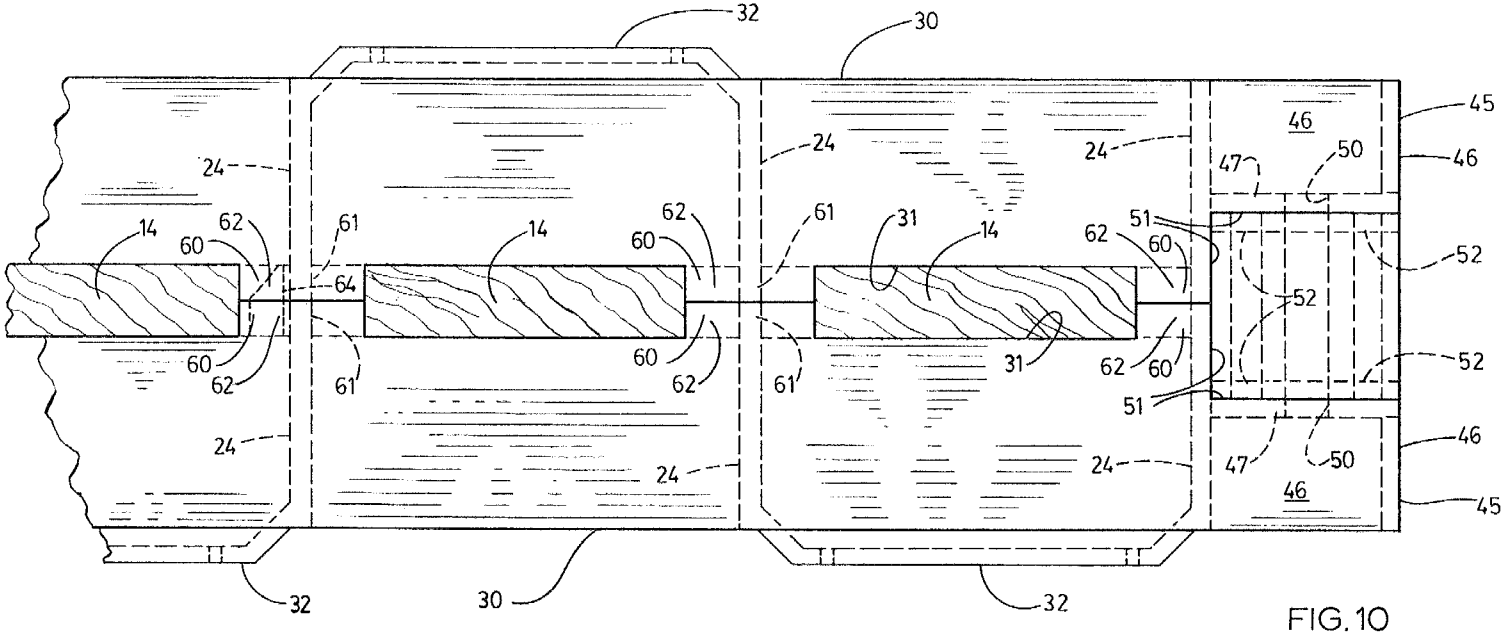
FIG. 10 is a still further enlarged fragmentary, end view taken on line 10—10 in FIG. 1 with the bolt and nut assembly thereof removed for illustrative convenience.

Each component individually mounts a pair of end housings 45 on the opposite end portions 21 thereof, as best shown in FIGS. 1 and 10. Each end housing has three upstanding side walls 46 extending to positions coincident with and forming part of the exterior side 30 of the component. The end housing has a floor 47 with an interior surface 48 and an exterior surface 49. A bolt hole 50 is extended through the floor. As shown in FIG. 10, the floor of each end housing is spaced from and substantially parallel to the plane defined by the interior side 31 of the component so as, in effect, to form a notch 51. A ridge 52 of predetermined size is mounted on the exterior surface 49 of the floor extending approximately from the adjacent reinforcing wall 24 of the component longitudinally of the component and preferably formed in two portions disposed on opposite sides of the bolt hole 50.

A plurality of T-shaped projections 60, sometimes referred to herein as "interior projections" are mounted on the interior side 31 of each component 22 extending outwardly therefrom. Each projection has a partition 61 which is, in effect, an extension of one of the reinforcing walls 24 beyond the interior side 31 of the component. The partition extends outwardly from the interior surface a distance equal to or slightly greater than half the thickness of one of the slats 12 to be employed in the demountable dehydrator tray 10. Each projection has stop flanges 62 disposed in right angular relation to the partition and constituting an extension of a common side wall 23 of the component, as best shown in FIG. 10. Adjacent partitions 61 bound or define an opening or receptacle 63. The receptacles of each component face laterally of the component in a common direction. The flanges 62 act to obstruct the openings in the opposite direction for purposes subsequently to be described. As can best be seen in FIG. 10, the partitions of the reinforcing walls 24 at the opposite ends of the component extend only to one side of their respective partitions to obstruct the adjacent receptacles on the common side of the component. These projections are thus L-shaped. As shown in FIG. 12, each component mounts an interlock projection 64 on the side of the T-shaped projection within the receptacle 63 which is the third successive receptacle from each opposite end portion 21. Thus, each component mounts a pair of the interlock projections in the pattern shown in FIG. 12. Each interlock projection extends beyond its respective T-shaped projection approximately one-quarter of an inch.

Although as previously noted, each component 22 can be constructed of a variety of materials and in a variety of different forms, the form heretofore described has been found well suited to fabrication as a single plastic molding in which all the portions described form a single, integral molded plastic member.

The tray frame 11 has a central or second cleat assembly 70 which is closely similar in structure to the first cleat assemblies 20 heretofore described. It will be understood that except as herein described, the structure of the first and second cleat assemblies is preferably identical. The second cleat assembly has opposite end portions 71 and is composed of a pair of longitudinally engageable components 72. Each of the components has a pair of spaced substantially parallel side walls 73 interconnected by reinforcing walls 74 which define passages or receptacles 75 extending through the component and being of substantially identical dimensions. The component has an exterior side 80 and an interior side 81 with reference to the disposition of these sides in assembled condition forming the second cleat assembly 70.

Figure 9:
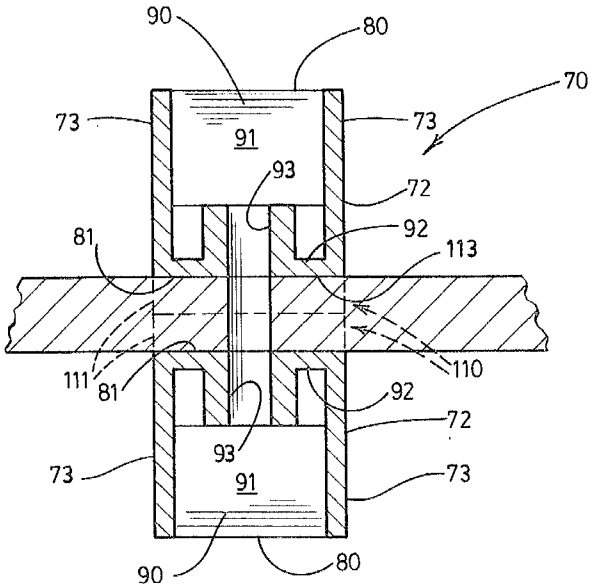
FIG. 9 is a fragmentary, longitudinal vertical section taken on line 9—9 in FIG. 1 with the bolt and nut assembly thereof removed for illustrative convenience.

A central housing 90 is mounted on the side walls 73 of the component within the centermost receptacle 75. The housing has spaced substantially parallel side walls 91 mounted on and interconnecting the side walls 73. The housing has a reinforced floor 92 having a bolt hole 93 extended therethrough, as best shown in FIG. 9.

A pair of T-shaped braces 94 are secured on the side walls 73 of the component 72 within the receptacles 75 on opposite sides of the centermost receptacle. The braces are individually connected to their respective adjacent reinforcing wall 74 in bracing relation.

Each component 72 mounts a pair of end housings 95 on the opposite end portions 71 thereof. Each end housing has three side walls 96 extending and a floor 97 spaced from the plane of the interior side 81 of the component 72. The floor has an interior surface 98 and an exterior surface 99. A bolt hole 100 is extended through the floor of the end housing. As can, perhaps best be seen in FIG. 6, the floor of each end housing is spaced from the plane of the interior side 81 of the component so as, in effect, to form a notch 101.

A plurality of projections 110 are mounted on the interior side 81 of the components 72. The projections have partitions 111 which constitute extensions of the reinforcing walls 74 extending outwardly from the interior side of the component a distance equal to or slightly greater than half the thickness of one of the slats 12. The projections 110 do not have stop flanges corresponding to the stop flanges 62 of each projection 60 of the first cleat assemblies 20. Thus, the partitions 111 define openings or receptacles 113 extending in unobstructed fashion through the component 72 facing laterally thereof in both directions. The spacing and positioning of partitions 111 is substantially identical to that of the spacing of the partitions 61 of the first cleat assemblies 20. It will be seen that in addition to the differences between the first and second cleat assemblies 20 and 70 already noted, the components 72 of the second cleat assembly 70 do not have projections corresponding to the projections 32 of the components 22 of the first cleat assembly 20. Additionally, the end housings 95 of the second cleat assembly do not mount ridges corresponding to the ridges 52 of the end housings 45 of the first cleat assemblies 20.

The tray frame 11 has a pair of side assemblies or members 120 having opposite end portions 121. Each side assembly is composed of a pair of endwardly engageable components 122. The components are of substantially identical and interchangeable construction each having one of the opposite end portions 121 of the side assembly and an opposite mating end portion 123. Each component 122 has a pair of spaced substantially parallel side walls 124 interconnected by an internal bracing structure 125, such as shown in FIG. 1 and sufficient to provide the desired strength and rigidity to the component. An outer end wall 126 is mounted on the side walls and bracing structure extending transversely thereof and constituting part of the opposite end portion 121. For purposes of illustrative convenience, the component can be viewed as having opposite sides 127 which are disposed substantially at right angles with respect to the side walls 124.

Figure 4:
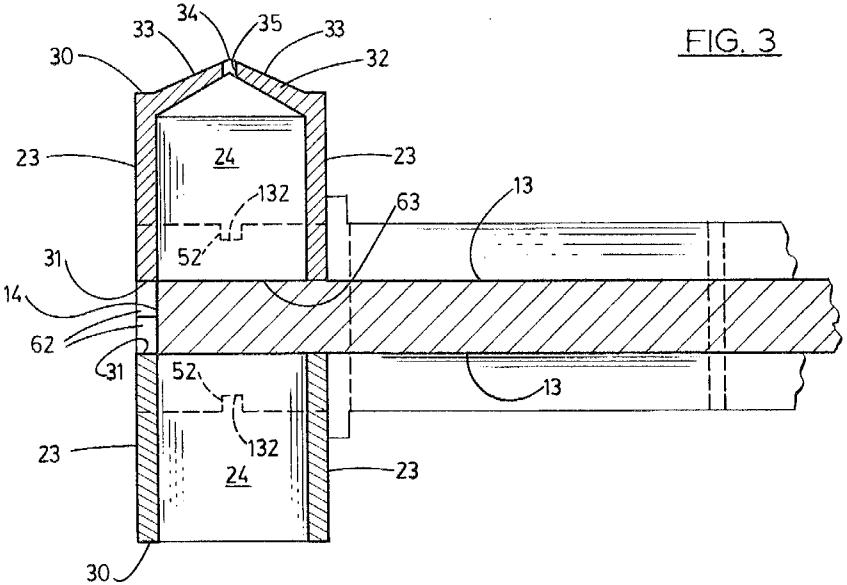
FIG. 4 is a still further enlarged, fragmentary longitudinal section taken on line 4—4 in FIG. 1.
Figure 7:
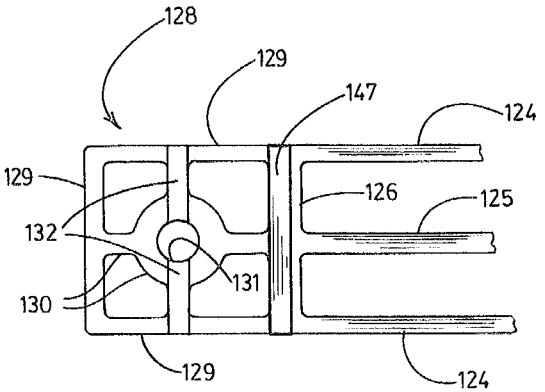
FIG. 7 is a fragmentary horizontal section taken on line 7—7 in FIG. 2 with the bolt and nut assembly thereof removed for illustrative convenience.

Each component 122 has an end housing 128 having three side walls 129, as best shown in FIG. 7. A bolt frame 130 is mounted on the three side walls within the end housing and has a bolt hole 131 extending therethrough along an axis substantially parallel to the outer end wall 126 thereof. The end housing has a groove or notch 132 extending thereacross in communication with the bolt hole and positioned and dimensioned to receive the ridge 52 of an end housing 45 of one of the components 22 of a first cleat assembly in mating relation, as best shown in FIG. 4.

Each component 122 mounts an inner end wall 139 on the side walls 124 and internal bracing structure 125 extending transversely thereof at the end of the component opposite the end housing 128. A mating housing 140 is borne by the inner end wall and has three side walls 141 having corresponding edges disposed in the same plane as one of the opposite sides 127 of the component 122, as best shown in FIG. 6. The opposite corresponding edges of the side walls 141 extend to a position defining a plane half way between and parallel to the planes defined by the opposite sides 127 so as to form, in effect, a notch 142. A bolt frame 143 is mounted within the side walls of the mating housing and has a bolt hole 144 extended therethrough, as best shown in FIG. 5.

Figure 5:
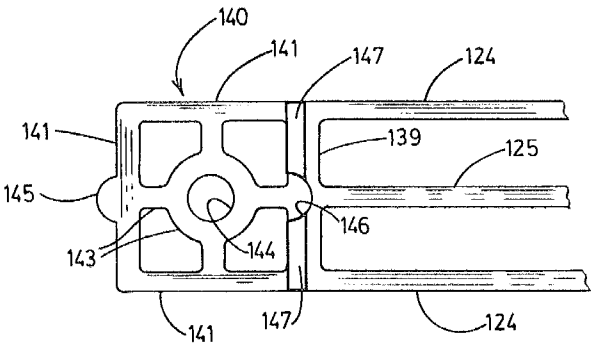
FIG. 5 is a fragmentary, horizontal section taken on line 5—5 in FIG. 2 with the bolt and nut assembly thereof removed for illustrative convenience.
Figure 6:
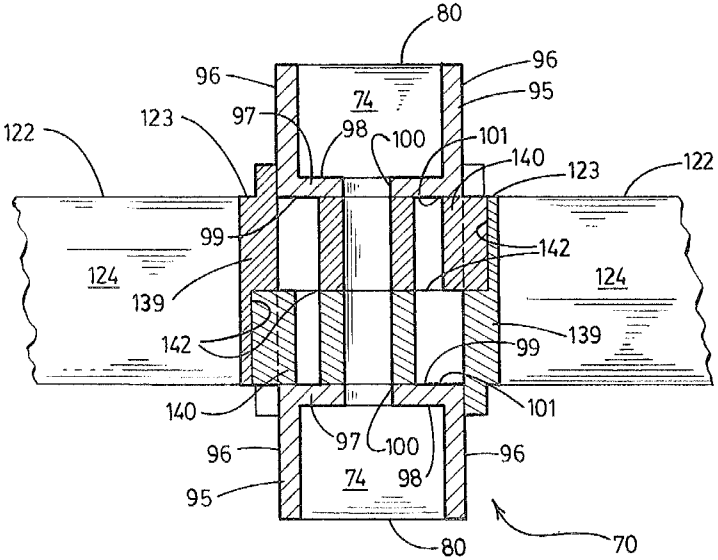
FIG. 6 is a fragmentary, longitudinal vertical section taken on line 6—6 in FIG. 1 with the bolt and nut assembly thereof removed for illustrative convenience.

A convex, semi-cylindrical projection 145 is mounted on the side wall 141 which is parallel to the inner end wall 139 and projects endwardly from the component, as shown in FIG. 5. The semi-cylindrical projection has a predetermined position and dimensions. A concave, semi-cylindrical recess 146, having substantially the same configuration as the projection 145, is formed in the inner wall 139 in communication with the notch 142. As can best be visualized in FIGS. 2 and 6, when the components 122 of a side assembly are inverted relative to each other with the mating housings 140 placed in overlapping engagement, the projection 145 of each component is received in mating engagement with the recess 146 of the other component.

The opposite end portion 121 and the mating end portion 123 each mount ridges 147 on their respective opposite sides 127 extending outwardly therefrom immediately adjacent to the end housing 128, in the case of the opposite end portion, and immediately adjacent to the mating housing 140, in the case of the mating end portion 123. As can best be seen in FIG. 5, the ridge 147 in proximity to the semi-cylindrical recess 146 is formed in two portions on opposite sides of the recess 146.

As will hereinafter be described, the frame 11 is retained in assembled condition using a plurality of suitable nut and bolt assemblies 150.

OPERATION

The operation of the described embodiment of the subject invention is believed to be clearly apparent and is briefly summarized at this point. As previously noted, the demountable dehydrator tray 10 can be used in kit form wherein the user initially assembles the tray from its component parts or alternatively can be sold as a completely assembled tray.

In the case of initial assembly of the demountable dehydrator tray 10, a pair of components 22 of the first cleat assemblies are positioned in spaced, substantially parallel relation on a supporting surface in the general spacing which can best be visualized in FIG. 1. Similarly, a component 72 of the second cleat assembly is positioned on the supporting surface between the components 22 spaced equal distances from and parallel to the components 22 as can be visualized in FIG. 1. Each of the components 22 and 72 is oriented with its interior side 31 or 81 respectively in upwardly facing relation. Slats 12 are then individually positioned in the receptacles 63 and 113 of the components so as to extend through corresponding receptacles of the first and second cleat assemblies with the opposite ends 14 of each slat individually disposed in juxtaposition to the stop flanges 62 of the components 22. When laid out in this manner, the partitions 61 and 111 automatically space the slats from each other to form a plurality of interstices or air passages 151 extending therebetween.

Figure 2:
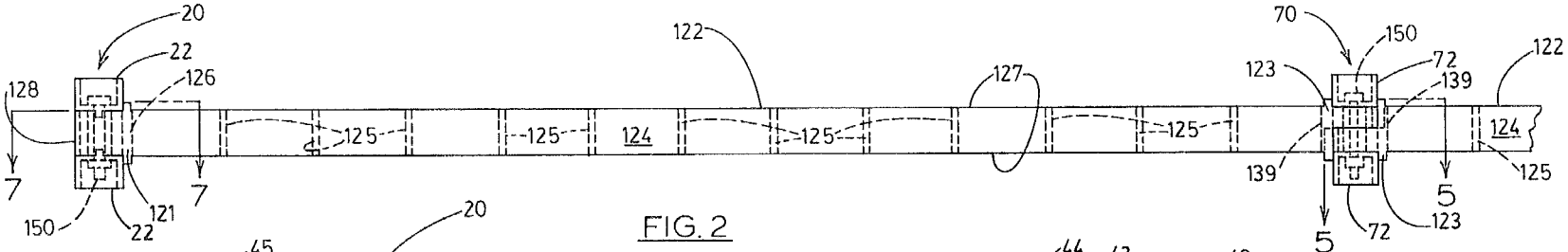
FIG. 2 is a somewhat enlarged, fragmentary side elevation taken on line 2—2 in FIG. 1.
Figure 3:
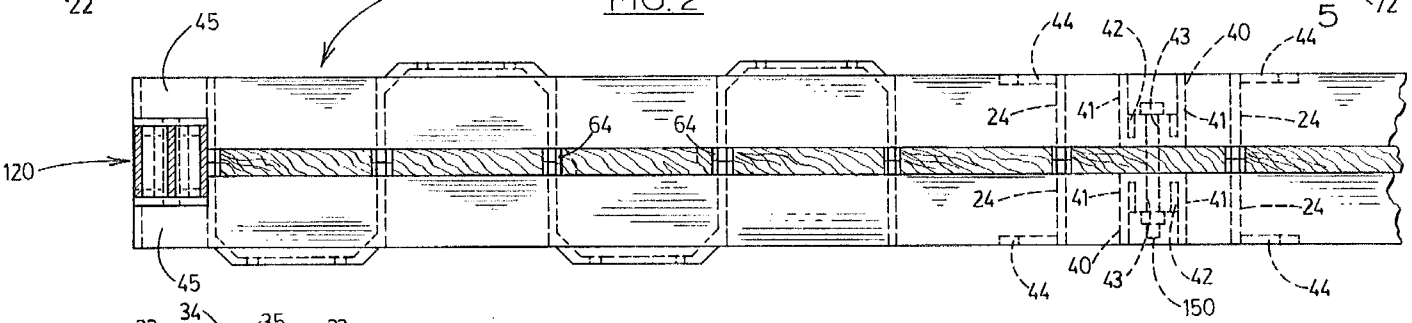
FIG. 3 is a somewhat further enlarged, fragmentary transverse section taken on line 3—3 in FIG. 1.
Figure 8:
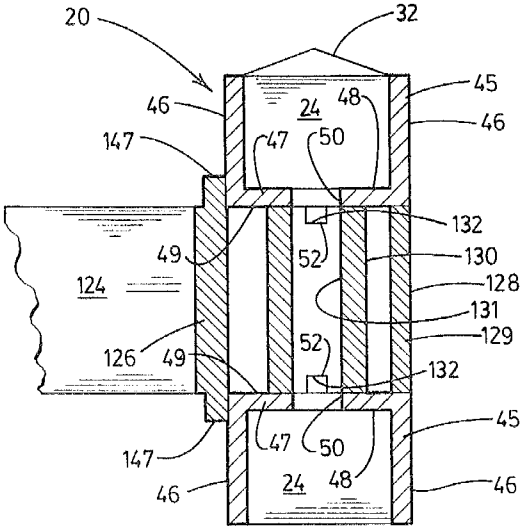
FIG. 8 is a fragmentary, longitudinal vertical section taken on line 8—8 in FIG. 1 with the bolt and nut assembly thereof removed for illustrative convenience.

The components 122 of the side assemblies 120 are then positioned in mating end-to-end engagement with each other so that the side assemblies extend on opposite sides of and parallel to the slats. The end housings 128 of the side assemblies are individually positioned in engagement with the end housings 45 and 95 of the first and second cleat assemblies 20 and 70 respectively. In the case of the end housings 45, the ridges 52 thereof are individually received in mating engagement with the notches 132 of the end housings 128, as best shown in FIGS. 2 and 8. Similarly, as best shown in FIGS. 2 and 6, the mating housings 140 of the side assemblies are positioned in overlapping mating engagement with the semi-cylindrical projection 145 of each component received in the semi-cylindrical recess 146 of the opposite component. The ridges 147 of the side assemblies 120 engage the side walls 23 of the first cleat assemblies 20 and the side walls 73 of the second cleat assembly 70 and insure that the frame 11 so formed is substantially precisely rectangular in configuration, as shown in FIG. 1. Similarly, the engagement of each ridge 52 at each opposite end portion 21 of each first cleat assembly in the notch 132 of the opposite end portion 121 of each side assembly 120 insures that the various components of the assemblies are precisely positioned for assembly.

Figure 11:
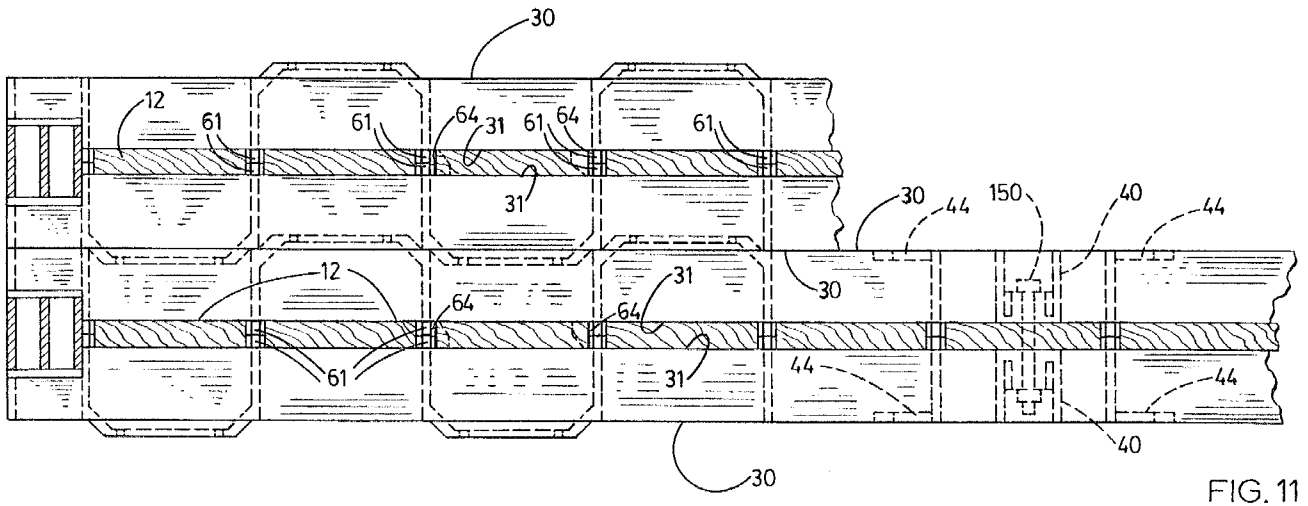
FIG. 11 is a somewhat reduced fragmentary, transverse vertical section showing a pair of the demountable dehydrator trays of the present invention stacked in register in interlocked relation.

Subsequently, the mating components 22 of the first cleat assemblies 20 and the mating components 72 of the second cleat assembly 70 are individually positioned in mating engagement with their respective components. In the case of each of the first cleat assemblies, the components 22 thereof are aligned so that the corresponding partitions 61 and stop flanges 62 of the components abut each other, as perhaps best shown in FIGS. 10 and 11. The interlock projections 64 interlock the components by the extension of each interlock projection into the corner of the receptacle 63 of the opposite component, as can best be visualized in FIG. 12. Similarly, the components 72 of the second cleat assembly are aligned so that the corresponding partitions 111 thereof abut each other. In this arrangement the opposite ends 14 of the slats 12 are individually captured in their respective receptacles 63 of the first cleat assemblies and extend through the corresponding receptacles 113 of the second cleat assembly 70.

Thereafter, bolt and nut assemblies 150 are individually mounted on the frame 11 and tightened into position. They are mounted in position, with respect to the first cleat assemblies 20, with the bolts thereof extending individually through the bolt holes 43 of the central housings 40, the bolt holes 50 of the end housings 45 and the bolt holes 131 of the side assemblies 120 therebetween. In the case of the second cleat assembly 70, the bolts thereof are individually extended through the bolt holes 93 of the central housings 90, the bolt holes 100 of the end housings 95 and the bolt holes 144 of the side assemblies therebetween. In the case of the slat 12 extending between the central housings 40 of the first cleat assemblies and the central housings 90 of the second cleat assembly, it is necessary to drill a hole through the slat for holes 43 and 93 respectively so as to permit extension of the bolts therethrough. The nuts are tightened on their respective bolts in the conventional manner so that the bolt and nut assemblies 150 securely, but releasably retain the components in the described assembled condition forming the demountable dehydrator tray 10 of the present invention.

The demountable dehydrator tray 10, so assembled, can be used over a long operable life with little or no damage to any portion of it. Over a long period of use, however, one or more of the slats 12 may become broken or otherwise damaged and require replacement in order to continue use of the tray. Replacement of one or more broken slats is easily accomplished by removing the bolt and nut assemblies 150 from one of the components 22 of one of the first cleat assemblies 20 so as to allow one of the components to be removed from the tray. Subsequently, the slats 12 which are to be removed are simply flexed upwardly out of their respective receptacles 63 and pulled from the tray by sliding the slats through the receptacles of the second cleat assembly 70 and from the receptacles 63 of the opposite first cleat assembly 20. Replacement of the slats is accomplished by reversing this procedure so as to position undamaged slats in the receptacles in the form shown in FIG. 1. The nut and bolt assemblies 150 are then again used to secure the component 22 which had been removed into its assembled configuration shown in FIG. 1.

Similarly, if one of the components 22 or 72 of the first and second cleat assemblies 20 and 70 become damaged or broken requiring replacement, it is necessary only to remove the nut and bolt assemblies 150 from those components which require replacement in order to remove the broken components and substitute identical, but undamaged components in their place. The nut and bolt assemblies are then again used to secure the components together in the described assembled condition.

If one of the components 122 of one of the side assemblies 120 becomes damaged or broken requiring replacement, it is necessary to remove only the nut and bolt assemblies 150 which extend through the bolt holes 131 and 144 of the damaged component. The damaged component is then slidably removed from the end portions 21 and 71 of the first and second cleat assemblies 20 and 70. Subsequently, an identical but undamaged replacement component is reinserted in the position of the component which was removed. The nut and bolt assemblies are again used to secure the new component in position.

If both components 122 of a side assembly 120 should require replacement, the three bolt and nut assemblies 150 thereof are removed to permit both components to be slidably removed from their respective opposite end portions 21 and 71 of the first and second cleat assemblies 20 and 70. As can best be visualized in FIGS. 1 and 10, removal of the side assembly does not release the slats since the partitions 61 and 111 capture the slats in their respective receptacles. Replacement components are then slidably inserted in the opposite end portions of the first and second cleat assemblies as described and again secured in position using the bolt and nut assemblies 150.

Accordingly, it will be seen that the demountable dehydrator tray 10 can be repaired by replacing any component thereof, including the slats 12, without varying the rectangular configuration of the tray and without risk of having the slats 12 fall out of the tray during such repair. It has been found that such repair of demountable dehydrator trays can be performed during the normal course of work in even large scale dehydrator operations. Thus, an individual monitoring the passage of the trays along an assembly line can remove damaged trays from the assembly line, replace the damaged or broken parts and reposition the repaired tray on the assembly line in the normal course of his work. This is not possible with conventional dehydrator trays which are commonly thrown into a pile of the damaged trays to be repaired at the end of the packing season or destroyed.

Therefore, the demountable dehydrator tray of the present invention possesses a durability and dependability of operation, permits the expeditious replacement of worn and broken slats and structural components of the frame, and insures that its original configuration is precisely preserved in the reassembled tray with little or no attention to this detail of assembly.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A demountable dehydrator tray comprising a plurality of substantially flat, semi-flexible slats having corresponding side edges and opposite ends; a pair of side members; a pair of cross members each composed of a pair of substantially identical components with each component having a predetermined interior side and an opposite exterior side, the interior side mounting a plurality of interior projections extending therefrom in spaced relation and arranged so that in an assembled tray the interior sides of the components of each cross member are disposed in juxtaposition and the corresponding interior projections of the components extend therebetween to form a plurality of slat receiving openings facing laterally of the cross member in a common direction and obstructed in a common opposite direction, the exterior side of each component having exterior projections and receptacles dimensioned for individual slidable receipt of the exterior projections of one component in the receptacles of another component and said exterior projections and said receptacles arranged on each component in a substantially identical asymmetric pattern permitting the exterior projections of one component of one assembled tray to be received in the receptacles of a component of another assembled tray placed in register therewith irrespective otherwise of the orientation of said trays; and means for releasably interconnecting the pair of cross members and pair of side members to form a substantially rectangular frame with the side members disposed in spaced, substantially parallel relation to each other with corresponding opposite end portions thereof interconnected by said cross members substantially right-angularly related to the side members and with said plurality of slats individually captured in and extending between corresponding slat receiving openings to form said assembled tray.

2. The demountable dehydrator tray of claim 1 wherein each of said exterior projections has a base from which extend surfaces convergent to an apex extending substantially parallel to a longitudinal axis of the component and each of said receptacles is dimensioned for fitted engagement with the base of an exterior projection.

3. The demountable dehydrator tray of claim 2 wherein each of said exterior projections has an opening extending through the apex thereof for draining fluid through said exterior projection.

* * * * *